US006080023A

United States Patent [19]

Meulemeester et al.

[11] Patent Number: 6,080,023

[45] Date of Patent: Jun. 27, 2000

[54] ELECTRICAL CONNECTOR WITH A CONTACT-ENSURING SLIDE

[75] Inventors: Dimitri Meulemeester, Oostkamp, Belgium; Peter Bauer, Regensburg; Wolfgang Hoschek, Mörfelden-Walldorf, both of Germany

[73] Assignee: Tyco Electronics Logistics AG, Steinach, Switzerland

[21] Appl. No.: 09/033,141

[22] Filed: Mar. 2, 1998

Related U.S. Application Data

[63] Continuation of application No. PCT/DE96/01610, Aug. 30, 1996.

[30] Foreign Application Priority Data

Sep. 1, 1995 [DE] Germany ..... 195 32 381

[51] Int. Cl.[7] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 5,044,994 | 9/1991 | Van Woensel | 439/681 |
| 5,085,599 | 2/1992 | Maejima et al. | 439/752 |
| 5,122,080 | 6/1992 | Hatagishi et al. | 439/752 |
| 5,299,958 | 4/1994 | Ohsumi | 439/752 |
| 5,468,162 | 11/1995 | Oda | 439/752 |
| 5,516,308 | 5/1996 | Yamanashi | 439/752 |
| 5,573,432 | 11/1996 | Hatagishi | 439/752 |

FOREIGN PATENT DOCUMENTS 0 306 635 A2 3/1989 European Pat. Off. .

*Primary Examiner*—Gary F. Paumen
*Attorney, Agent, or Firm*—Herbert L. Lerner; Laurence A. Greenberg; Werner H. Stemer

[57] ABSTRACT

The electrical connector has a basic body, at least one contact element inserted into the basic body, and a contact-ensuring slide. The slide is brought into engagement with the basic body and, when it is properly engaged, the contact element is ensured not to be displaced from its proper position in the basic body. The basic body and the contact-ensuring slide are formed with guide elements for specifically guiding the basic body and the contact-ensuring slide when the latter two are brought into engagement. Latching elements latch the basic body and the contact-ensuring slide. The guide elements and the latching elements of the electrical connector are spatially separated from one another. The contact-ensuring slide is placed onto the basic body along a direction which is transverse to a plug-in direction of the electrical connector, and it includes an end plate which covers the end face of the basic body when said contact-ensuring slide is disposed on the basic body, except for contact openings through which the contact elements inside the connector are accessible.

4 Claims, 6 Drawing Sheets

ELECTRICAL CONNECTOR WITH A CONTACT-ENSURING SLIDE

CROSS-REFERENCE TO RELATED APPLICATION

This application is a continuation of copending international application Ser. No. PCT/DE96/01610, filed Aug. 30, 1996, which designated the United States.

BACKGROUND OF THE INVENTION

1. Field of the Invention

The present invention relates to an electrical connector with a basic body, at least one contact element, which is insertible into the basic body and which makes contact with a corresponding mating component, and a contact-ensuring slide, which can be brought into engagement with the basic body and by means of which it is possible in the engaged position to prevent removal of the at least one contact element from its proper position in the basic body, the basic body and the contact-ensuring slide having guide elements for specifically guiding the basic body and the contact-ensuring slide when the latter two are brought into engagement, and latching elements for latching the basic body and the contact-ensuring slide.

Contact-ensuring slides in such electrical connectors are generally, but not exclusively, used as secondary safeguards against the inadvertent removal of the contact elements (e.g. the pins or the sockets of plug-and-socket connectors) from their proper position inside the basic body of the electrical connector.

The prior art contact-ensuring slides have an essentially U-shaped cross section with mutually opposite limbs. They are brought into engagement with the basic body when they are slid over the basic body or into correspondingly dimensioned cutouts. The end faces of the limbs thereby serve as guide elements, and the edge sections and/or the mutually facing surfaces of the limbs are provided with latching elements and/or they are constructed as latching elements, which, in the contact-ensuring position of the contact-ensuring slide, latch with corresponding mating components on the basic body. This latching connection keeps the contact-ensuring slide and the basic body in engagement in this position. In the latched state, contact-ensuring elements, provided at corresponding points on the contact-ensuring slide and having the form of pin-like protuberances project into corresponding cutouts, provided adjacent to the contact elements of the electrical connector, in the basic body. Any extraction of the contact elements is thereby prevented.

The contact-ensuring slides weaken the mechanical strength of the electrical connectors quite considerably. This is due to the cutouts which must be formed in the basic body and/or to the elastic construction of the basic body and/or the contact-ensuring slide. A further disadvantage is found in the existing risk of canting which, for the proper mounting of the contact-ensuring slide on the basic body, requires a relatively high measure of skill and is correspondingly subject to error.

SUMMARY OF THE INVENTION

It is accordingly an object of the invention to provide an electrical connector with a contact-ensuring slide, which overcomes the above-mentioned disadvantages of the heretofore-known devices and methods of this general type and which, on the one hand, allows simple and reliable mounting of the contact-ensuring slide on the basic body and, on the other hand, which assures a high degree of mechanical strength in the basic body and the contact-ensuring slide.

With the foregoing and other objects in view there is provided, in accordance with the invention, an electrical connector, comprising:

a basic body defining a plug-in direction along which the electrical connector is plugged together with another electrical connector for electrical contact;

at least one contact element insertible into the basic body and adapted to contact a corresponding mating component;

a contact-ensuring slide to be brought into engagement with the basic body for preventing a removal of the contact element from a defined position thereof in the basic body, the contact-ensuring slide being slidable onto the basic body transversely to the plug-in direction;

the basic body and the contact-ensuring slide being formed with mutually complementary guide elements for guiding the basic body and the contact-ensuring slide upon being brought into mutual engagement, and with latching elements for latching the basic body and the contact-ensuring slide; and the contact-ensuring slide including an end plate for covering an end face of the basic body when the contact-ensuring slide is disposed on the basic body.

The spatial, and thus also functional separation or decoupling of the guide elements and the latching elements permits the latter to be configured in such a way that they are optimally adapted to whatever task the electrical connector is intended.

That is to say, because they are free of latching elements the guide elements can be constructed immovably and non-deformably and, because they are not provided on guide elements, the latching elements can be constructed and arranged such that they do not additionally reduce the cross section of the basic body and/or contact-ensuring slide, which is small in any case in the region of the guide elements.

The rigid construction of the guide elements lends the latter a strength which can prevent canting of the contact-ensuring slide and of the basic body when the latter are brought into engagement, and consequently permits a simple assembly which is not subject to error.

The rigid construction of the guide elements and, furthermore, the possibility of minimizing the reduction in cross section of the basic body and/or the contact-ensuring slide by suitable arrangement of the latching elements, furthermore permit in the simplest way the production of electrical connectors and/or connector parts which is optimized in terms of its mechanical strength.

The invention thus provides for an electrical connector which, on the one hand, permits the contact-ensuring slide to be mounted on the basic body simply and in a reliably secured fashion and, on the other hand, permits the basic body and the contact-ensuring slide to be produced with a high mechanical strength.

In accordance with an added feature of the invention, the basic body is formed with a base segment and a contiguous contact-ensuring segment.

In accordance with an additional feature of the invention, the contact-ensuring segment of the basic body and the contact-ensuring slide are constructed such that the contact-ensuring slide is guided along the guide elements while being plugged onto the contact-ensuring segment of the basic body.

In accordance with another feature of the invention, the contact-ensuring segment of the basic body has a substantially rectangular cross section.

In accordance with a further feature of the invention, the contact-ensuring slide has a substantially U-shaped cross section.

In accordance with again an added feature of the invention, the guide elements of the basic body include guide grooves formed in mutually opposite walls of the contact-ensuring segment, the guide grooves extending along a plug-on direction defined by the contact-ensuring slide. The guide elements of the contact-ensuring slide include guide rails formed on mutually opposite walls of the contact-ensuring slide, the guide rails extending along a plug-on direction defined by the contact-ensuring slide.

In accordance with again an additional feature of the invention, the guide elements of the basic body and the guide elements of the contact-ensuring slide have defined cross sections ensuring that the guide element are brought into and out of mutual engagement solely by a relative movement in a direction along the guide elements. Preferably, the guide elements of the basic body and of the contact-ensuring slide have essentially trapezoidal cross sections.

In accordance with again another feature of the invention, the guide elements have cross-sections which are mixed in form and dimension such that the basic body and the contact-ensuring slide can be plugged together only in a proper mutual orientation.

In accordance with again a further feature of the invention, the guide elements of the basic body and of the contact-ensuring slide are substantially immovable and non-deformable relative to the basic body and the contact-ensuring slide, respectively.

In accordance with yet an added feature of the invention, the guide elements extend substantially orthogonally relative to the plug-in direction.

In accordance with yet an additional feature of the invention, the latching elements are mutually complementary latching protuberances and latching depressions formed on and in the basic body and the contact-ensuring slide in planes extending substantially orthogonally to the plug-in direction.

In accordance with yet another feature of the invention, the contact-ensuring segment and the base segment each has an end face, and wherein the latching elements of the basic body are formed in the end face of the contact-ensuring segment and in the end face of the base segment.

In accordance with yet a further feature of the invention, the contact-ensuring slide has an end wall and a rear wall, and the latching elements of the contact-ensuring slide are formed on the end wall and on the rear wall of the contact-ensuring slide.

In accordance with yet again an added feature of the invention, the latching elements engage along a defined latching direction, and the latching direction extends substantially orthogonally to a direction of alignment of the guide elements.

In accordance with yet again an additional feature of the invention, the latching elements are provided in a given number and a given configuration which permits the basic body and the contact-ensuring slide to latch in a preliminary latched position and in a final latched position.

In accordance with yet again another feature of the invention, the contact-ensuring slide is substantially U-shaped with limbs carrying the guide elements, and wherein the end plate is connected to the limbs.

In accordance with yet again a further feature of the invention, the end plate is formed with contact openings through which the contact elements of the electrical connector are accessible, and wherein the basic body is formed with corresponding contact openings, the contact openings in the end plate and in the basic body coming into mutual alignment only when the contact-ensuring slide is completely plugged onto the basic body.

In accordance with a concomitant feature of the invention, the end plate is formed with protuberances and cutouts for coding the electrical connector.

Other features which are considered as characteristic for the invention are set forth in the appended claims.

Although the invention is illustrated and described herein as embodied in an electrical connector with a contact-ensuring slide, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The invention will now be described with the aid of a plug-in connector in which the contact elements to be secured are represented by two mutually adjacent contact sockets. It will be appreciated, however, that the invention is not restricted to such electrical connectors; rather, it can be applied wherever any arbitrary number of contact elements of any type of whatever electrical connectors are to be protected against removal from their proper position in the electrical connector.

Figure 1:
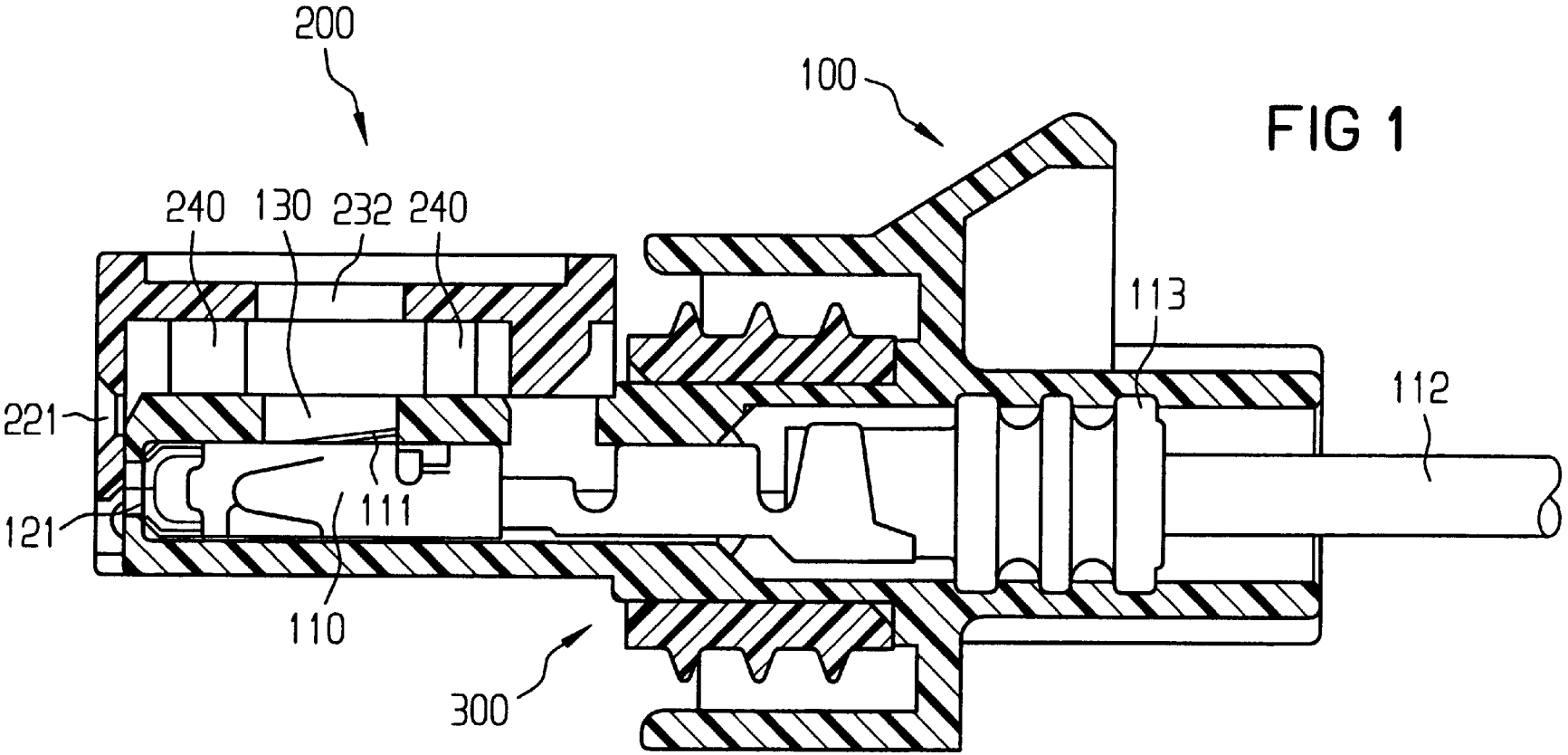
FIG. 1 is a longitudinal sectional view of an incompletely assembled electrical connector according to the invention.
Figure 2:
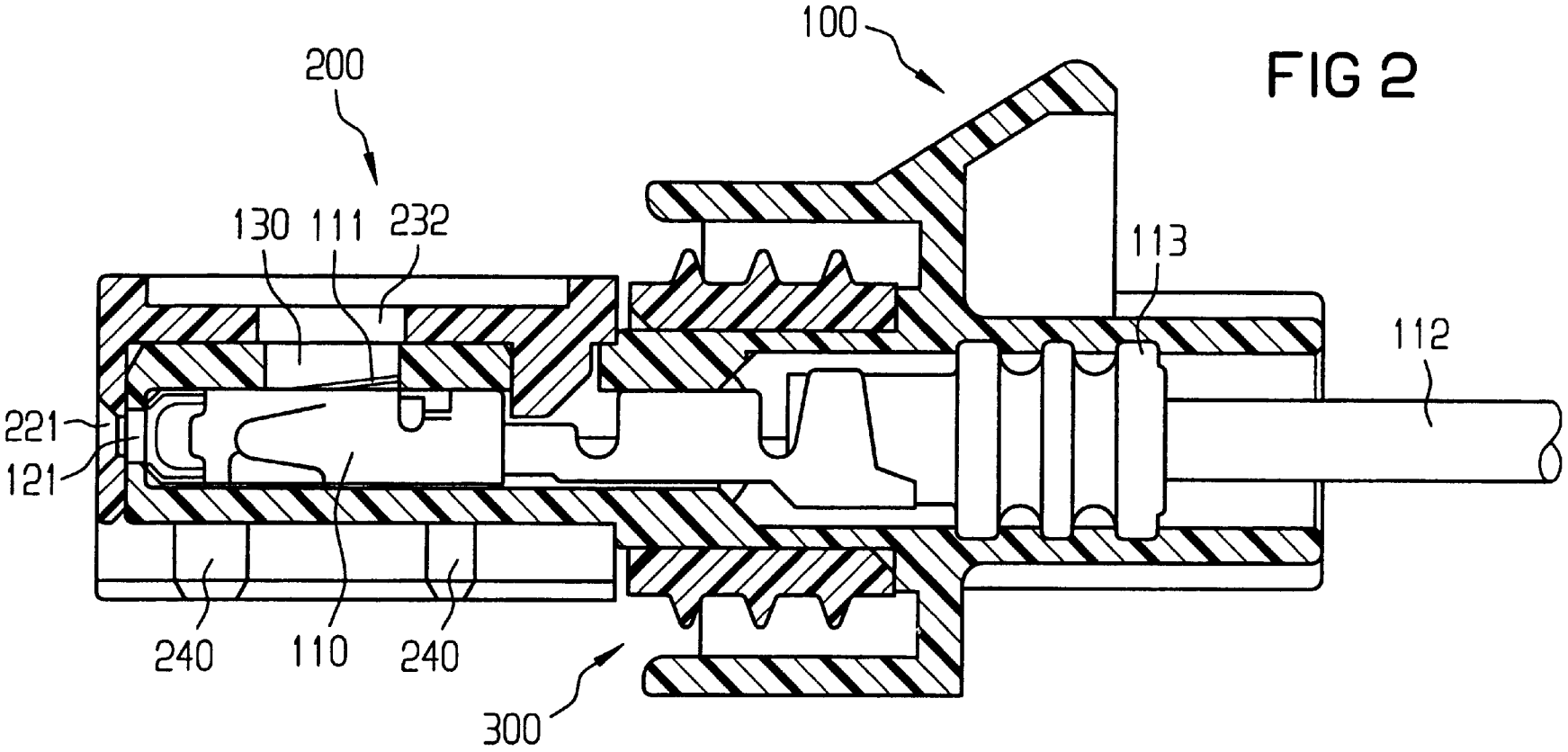
FIG. 2 is a similar view thereof in a completely assembled state.

Reference is now had to the figures of the drawing in detail and first, particularly, to FIGS. 1 and 2 thereof, which show the connector in a partially assembled state and a fully assembled state, respectively.

The electrical connector is assembled from a basic body 100, a contact-ensuring slide 200, and a radial seal 300 provided between these elements and which encloses the basic body completely.

The basic body 100 contains in its interior contact elements in the form of two contact sockets 110 disposed next to one another.

The contact sockets 110 are insertable into the basic body 100 from the right-hand side (all directional references, unless otherwise indicated, are in relation to the orientation illustrated in FIGS. 1 and 2). Each of the sockets 110 has a latching element in the form of an elastic spring lug 111, which projects obliquely outward from their outer surface and which latch into respective latching windows 130 provided at corresponding points in the basic body 100. The respective contact sockets 110 thus snaps into proper position inside the basic body 100 after reaching the correct point.

In the latched state, the contact sockets 110 are secured against extraction from the basic body 100. They can be extracted, however, when the respective spring lugs 111 are pressed downward from outside through the latching windows 130. This can be done with any suitable tool or object.

In order to prevent such unlatching accidentally, the contact-ensuring slide 200 is brought into engagement with the correspondingly constructed basic body 100 in such a way that the contact sockets 110 are locked in their correct position by means of correspondingly constructed contact-ensuring elements of the contact-ensuring slide. This secondary securing mechanism will be explained in further detail in the following text.

The contact sockets 110 are connected electrically to a connecting lead 112 leading to the electrical connector. The connecting lead 112 is guided in the interior of the basic body 100 by a sealing sheath 113.

On its left-hand end face 120, the basic body is formed with windows, i.e., contact openings 121 through which the pins of a non-illustrated mating component of the electrical connector can be electrically connected to the contact sockets 110.

The secondary securing mechanism will now be described with particular reference to the depiction of the basic body 100 in FIGS. 3 to 5 and various other views.

Figure 3:
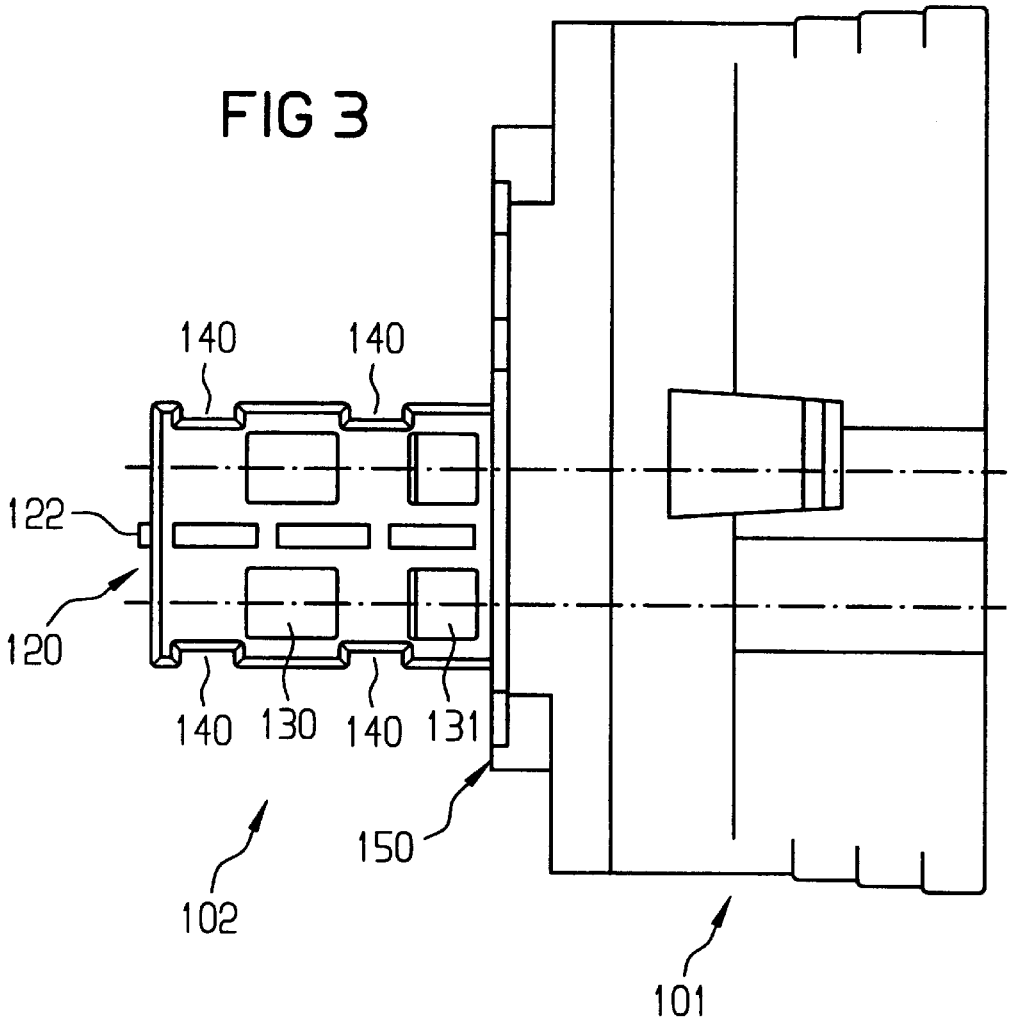
FIG. 3 is a top plan view, in relation to FIGS. 1 and 2, of the basic body of the electrical connector.

As is particularly visible in FIG. 3, the basic body 100 has a base segment 101 (on the right-hand side) and a contact-ensuring segment 102 (on the left-hand side).

The contact-ensuring segment 102 is prepared for receiving thereon the contact-ensuring slide 200, which will be described in more detail in the following. This preparation is assured with the following features of the contact-ensuring segment 102:

1) contact-ensuring elements, which are described more precisely later, of the contact-ensuring slide 200 can be positioned in the vicinity of the contact-ensuring elements to be secured;
2) guide elements are provided for defined guiding of the basic body 100 and contact-ensuring slide 200 when the latter are brought into engagement; and
3) latching elements are provided for latching the basic body 100 and contact-ensuring slide 200.

For the purpose of the just-described positioning of the contact-ensuring elements of the contact-ensuring slide 200, there is provided one securing window 131 per contact socket 110 in the upper surface, shown in the plan view of FIG. 3, of the contact-ensuring segment 102 of the basic body 100.

The securing windows 131 are formed between the respective latching windows 130 and the base segment 101 of the basic body 100. A contact-ensuring element of the contact-ensuring slide 200 can thus be positioned through the securing window immediately behind the contact socket 110.

Plugging the contact-ensuring elements of the contact-ensuring slide 200 through the securing windows 131 may be facilitated in that the securing windows are larger than the assigned contact-ensuring elements, and the bounding surfaces surrounding the securing window in the basic body 100 are correspondingly beveled.

On the basic body 100, the previously mentioned guide elements are formed by groove-like cutouts extending on each of the two side faces of the contact-ensuring segment 102 and in the form of guide grooves 140.

Two guide grooves 140 are provided per side face, and all the guide grooves extend essentially parallel to one another. The alignment and the extent of the guide grooves 140 are selected such that the contact-ensuring slide 200 can be pushed (from above) onto the contact-ensuring segment 102 of the basic body 100. At the same time it is guided along the guide grooves perpendicular to the direction along which the electrical connector can be connected to a corresponding mating component.

The guide grooves 140 preferably have a cross section which prevent the mutually assigned guide elements of the basic body 100 and contact-ensuring slide 200 from being capable of lateral displacement and/or of coming out of engagement during assembly and/or in the finally mounted state. In addition, or alternatively, it can be provided for the guide elements of the basic body and of the contact-ensuring slide, and the sections, bearing the guide elements, of the respective connector components to be constructed accurate to fit, non deformably and immovably in such a way that the latter (if appropriate, even without the above-mentioned special cross-sectional configuration) cannot be laterally displaced and/or come out of engagement.

The guide grooves 140 can, moreover, have cross sections which are (in some cases) of different size or of different configuration. This measure prevents the basic body 100 and the contact-ensuring slide 200 from being plugged together in an improper orientation.

The previously mentioned latching elements of the basic body 100 are formed by latching protuberances 122 formed on the end face 120 of the contact-ensuring segment 102 of the basic body 100, and by latching depressions 151 on an end face 150, bordering on the contact-ensuring segment 102, of the base segment 101 of the basic body 100.

More precisely, with particular reference to the plan view of the end face basic body 100 shown in FIG. 4, there are provided on the end face 120 of the contact-ensuring segment 102 between the contact openings 121, two latching protuberances 122 which are situated one above the other and sequentially latch with a single assigned latching protuberance, described more precisely later, of the contact-ensuring slide 200 when the basic body 100 and contact-ensuring slide 200 are plugged together.

Still with reference to FIG. 4, there are provided on the end face 150 of the base segment 101, to the right and to the left next to the opening of the contact-ensuring section 102 into the base segment 101, a total of three pairs, arranged next to one another, of latching depressions 151 which are situated one above another and sequentially latch with in each case a single assigned latching protuberance, described more precisely later, of the contact-ensuring slide 200 when the basic body 100 and contact-ensuring slide 200 are plugged together.

Figure 4:
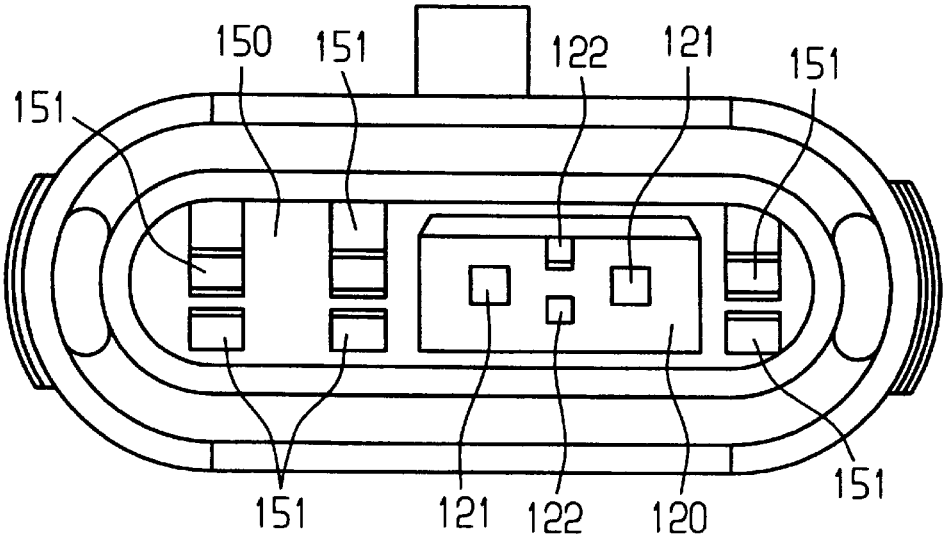
FIG. 4 is a left side view, in relation to FIGS. 1 and 2, of the basic body.
Figure 5:
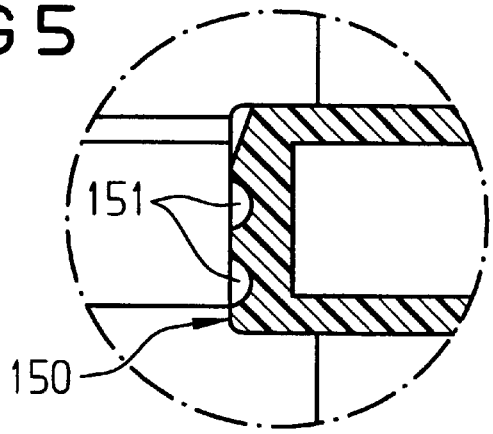
FIG. 5 is a lateral sectional view taken through a latching depression in the basic body shown in plan view in FIG. 4.

With reference to the plan view of FIG. 4 and the section of FIG. 5, the end face 150 of the base segment can be beveled from an outer boundary thereof in such a way that the latching protuberances of the contact-ensuring slide 200 are directed along the bevels to the latching depression 151 of the pair of latching depressions which is in each case the upper one in accordance with the representation in FIGS. 4 and 5.

The latching protuberances 122 and the latching depressions 151 are disposed in such a way that it is possible to effect a latching between the basic body 100 and contact-ensuring slide 200 which has the effect that the basic body 100 and the contact-ensuring slide 200 are held together by forces which act essentially parallel to the direction along which the electrical connector can be connected to a corresponding mating component (connecting direction). However, contrary to established convention, the contact-ensuring slide 200 is not held in its entirety in a correspondingly constructed groove-like cutout in the basic body, mutual displacement along the connecting direction of the electrical connector is reliably prevented nevertheless, since the guide elements provided in this exemplary embodiment reliably prevent displacement in this direction.

The latching protuberances 122 and the latching depressions 151 are each in pairs one above the other. This permits a preliminary latched position and a final latched position between the basic body 100 and contact-ensuring slide 200. Again in contrast with prior art electrical connectors, the retention of the basic body 100 and contact-ensuring slide 200 in the preliminary latched position and in the final latched position is virtually equally effective because, due to the prevention of a lateral displacement, the construction of the guide elements at the same time also virtually completely excludes canting of the basic body and contact-ensuring slide.

Reference will now be had to FIGS. 6–9, with the aid of which the contact-ensuring slide 200 will be described in detail.

The contact-ensuring slide 200 has a shape such that it can be plugged onto the contact-ensuring segment 102 of the basic body 100 from above (relative to FIGS. 1, 2), i.e., transversely (essentially perpendicular) to the connecting direction of the electrical connector.

The contact-ensuring slide 200 has an essentially U-shaped cross section. The limbs 210 of the contact-ensuring slide 200 are connected to support devices 211, which are respectively arranged laterally outside the U-shape and lend the limbs increased stability. On the end face shown on the left in accordance with the representation in FIGS. 1 and 2, the contact-ensuring slide 200 has, moreover, an end plate 220 connected to the limbs 210 and the limb support 211, and this likewise ensures, inter alia, increased stability of the limbs.

When the contact-ensuring slide 200 is plugged onto the basic body 100, the end plate 220 is pushed in front of the contact-ensuring segment end face 120 of the basic body; the end face 120 of the basic body 100 is completely covered by the end plate 220 of the contact-ensuring slide 200 in the completely mounted state.

Figure 6:
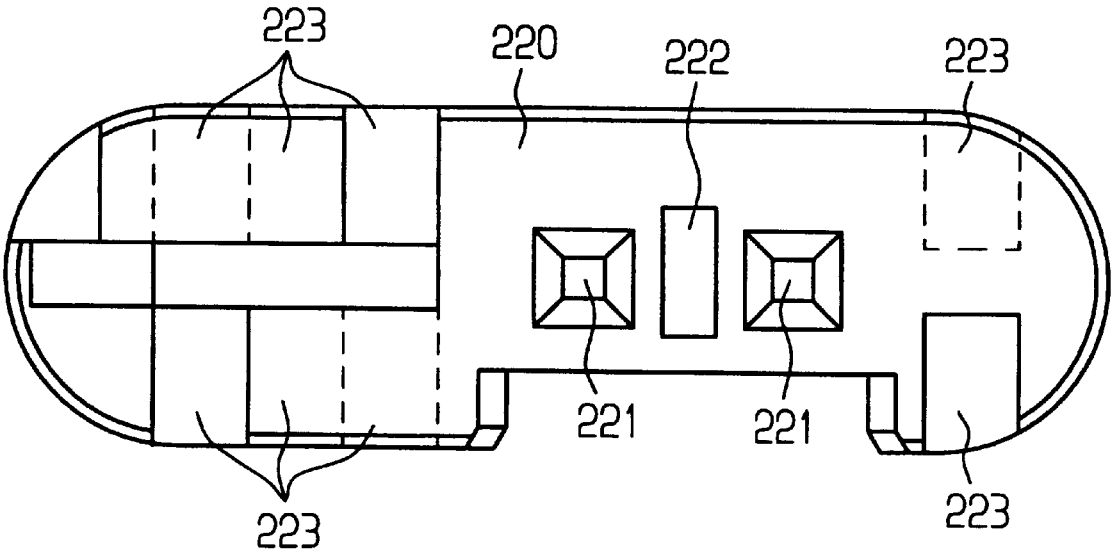
FIG. 6 is a left side view, in relation to FIGS. 1 and 2, of the contact-ensuring slide of the electrical connector.

The end plate 220 of the contact-ensuring slide 200 is illustrated in FIG. 6.

The end plate 220 has a number of contact openings 221. That number corresponds to the number of the contact elements of the electrical connector. The contact openings 221 come to be situated above the contact openings 121 of the basic body in the completely assembled state of the contact-ensuring slide 200 and basic body 100 (and only then). In the incompletely plugged-together state of the contact-ensuring slide 200 and basic body 100, the contact openings 121 of the end face 120 of the basic body 100 are, by contrast, blocked by the end plate 220 of the contact-ensuring slide 200. Electrical contact between the electrical connector according to the invention and a corresponding mating component is therefore possible only if the contact-ensuring slide 200 is properly and completely mounted onto the basic body 100. It can be prevented in this way that when the electric connection is produced a contact element having no secondary safeguard, or only a defective one, can be displaced from its proper position. Conversely, the contact-ensuring slide 200 can, however, also not be removed from the basic body when the electrical connector is connected to a corresponding mating component.

Between the contact openings 221, the end plate 220 of the contact-ensuring slide 200 has a latching element in the shape of an elongated latching window 222. The size and position of the latching window 222 are selected such that in the completely plugged-together state of the contact-ensuring slide 200 and basic body 100 the two latching protuberances 122 (see FIG. 4) provided on the end face 120 of the contact-ensuring segment 102 of the basic body 100 can come to be situated precisely simultaneously in the latching window 222 of the contact-ensuring slide 200.

The section, situated below the latching window 222 in accordance with FIG. 6, of the end plate 220 of the contact-ensuring slide 200 is dimensioned such that it comes to be situated in a preliminary latched position between the latching protuberances 122 situated one above the other in accordance with FIG. 4; in the preliminary latched position, the upper latching protuberance 122 in accordance with FIG. 4 is located in the lower section of the latching window 222 in accordance with the representation in FIG. 6, and in accordance with the representation in FIG. 6, the lower latching protuberance 122 in accordance with FIG. 4 borders from below on the end plate 220 of the contact-ensuring slide 200.

Thus, there are precisely defined latched states both in the preliminary latched position and in the final latched position.

The end plate 220 of the contact-ensuring slide 200 has coding points 223 at which the end plate can be provided with cutouts or protuberances for engagement with correspondingly positioned and dimensioned protuberances and cutouts of a mating component of the electrical connector. These coding measures help to prevent electrical connectors not assigned to one another (differently coded) from being connected to one another.

The coding measures on the end plate 220 of the contact-ensuring slide 200 prove to be advantageous because this connector component can be exchanged easily, and the electrical connector can thus be adapted quickly to any of a variety of changed conditions.

As already indicated above, the end plate 220 of the contact-ensuring slide 200 contributes furthermore to the fact that the limbs 210 of the contact-ensuring slide can be held firmly and immovably in their predetermined position, thus minimizing the risk of canting of the contact-ensuring slide 200 when being plugged onto the basic body 100 and/or of inadvertently detaching the contact-ensuring slide 200 from the basic body 100.

As follows from the above description of the end plate 220 of the contact-ensuring slide 200, the end plate is an element which has an exceptionally positive effect on the production, the handling, and, above all, the operational reliability of the electrical connector.

Such an end plate is possible only if the contact-ensuring slide is not, as usual, inserted into a groove-like cutout provided for the purpose in the basic body, but is mounted onto a free end section of the basic body. This, in turn, is possible only if the guide elements and/or the latching elements of the basic body and the contact-ensuring slide are capable of holding the contact-ensuring slide reliably on the free end section of the basic body.

The guide elements and latching elements of the contact-ensuring slide which are optimized in this regard are described in detail below.

The guide elements of the contact-ensuring slide 200 are guide rails 240 projecting from the mutually facing surfaces of the limbs 210 of the contact-ensuring slide.

Figure 9:
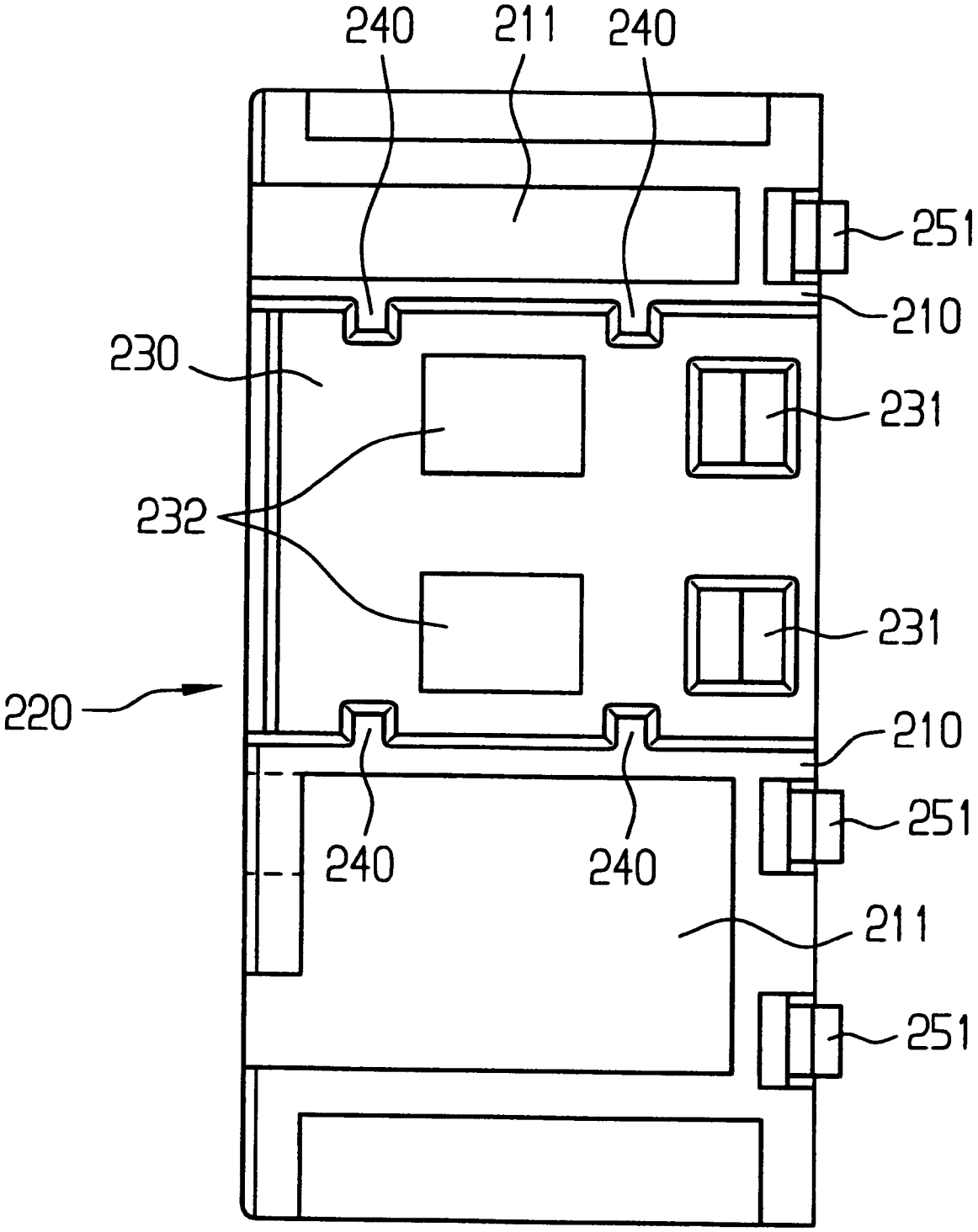
FIG. 9 is a bottom plan view, in relation to FIGS. 1 and 2, of the contact-ensuring slide of the electrical connector shown therein.

The guide rails 240 are visible in the plan views of FIGS. 1 and 2 and in the section of FIG. 9. Their number, their cross section, their position and their extent are adapted to the guide grooves 140 of the basic body 100 which have already been described in detail above.

As a result of a suitable configuration of the guide grooves 140 and the guide rails 240, and of a correspondingly non-deformable and immovable construction of the guide grooves, guide rails and the elements bearing the same, the basic body 100 and the contact-ensuring slide 200 can be moved relative to one another only in the direction of the guide grooves or guide rails.

The stiff construction of the guide rails 240, which makes a substantial contribution to achieving the reliable guidance described, is possible by virtue of the fact that the limbs of the contact-ensuring slide 200 are essentially allotted only a guiding function and—contrary to prior art contact-ensuring slides—are not allotted a latching function for locking the contact-ensuring slide and basic body in a preliminary latched position or a final latched position (in this case, the limbs of the contact-ensuring slide would have to be of elastic construction). Consequently, like the latching elements of the basic body 100, the latching elements of the contact-ensuring slide 200 are also separated spatially, and thus also functionally from the guide elements.

A portion of the latching elements provided on the contact-ensuring slide 200 (latching window 222 in the end plate 220) has already been described above.

Further latching elements are provided on the rear of the contact-ensuring slide 200. These are latching noses 251 provided on respective free ends of resilient lugs 250. These latching noses 251 are matched in their number, their arrangement and the dimensioning to the latching depressions 151 of the basic body 100 which have already been described above (see FIGS. 4 and 5). They are shown in plan view in FIG. 7 and in a lateral sectional view in FIG. 8.

When the contact-ensuring slide 200 is mounted on the basic body, the respective latching noses 251 slide over the bevels provided above the latching depressions 151 in the basic body 100 and leading to the latching depressions 151, and then initially latch into the upper latching depression 151 in accordance with the representation in FIG. 5.

Latching into the upper latching depressions 151 takes place simultaneously with the latching of the upper latching protuberance 122 of the basic body in accordance with FIG. 4 into the lower section of the latching window 222 of the contact-ensuring slide 200 in accordance with FIG. 6; this state corresponds to the preliminary latched position already mentioned above.

As mounting continues, the latching noses 251 leave the upper latching depressions 151 and finally latch into the respectively lower latching depressions 151 in accordance with the representation in FIG. 5.

Latching into the lower latching depressions 151 takes place simultaneously with the latching of the lower latching protuberance 122 of the basic body in accordance with FIG. 4 into the latching window 222 of the contact-ensuring slide 200; this state corresponds to the final latched position already mentioned above.

In the final latched position, securing elements which are provided on the underside of a cover plate 230 connecting the limbs 210 of the contact-ensuring slide 200 and have the form of securing pins 231 are inserted into the securing windows 131 of the basic body 100 already described above.

The securing pins 231 are constructed with reference to number, arrangement and dimensioning in such a way that, on the one hand, they are adapted to the securing windows 131 of the basic body and that, on the other hand they prevent inadvertent removal of the contact-ensuring elements thereby secured from their proper position.

Figure 7:
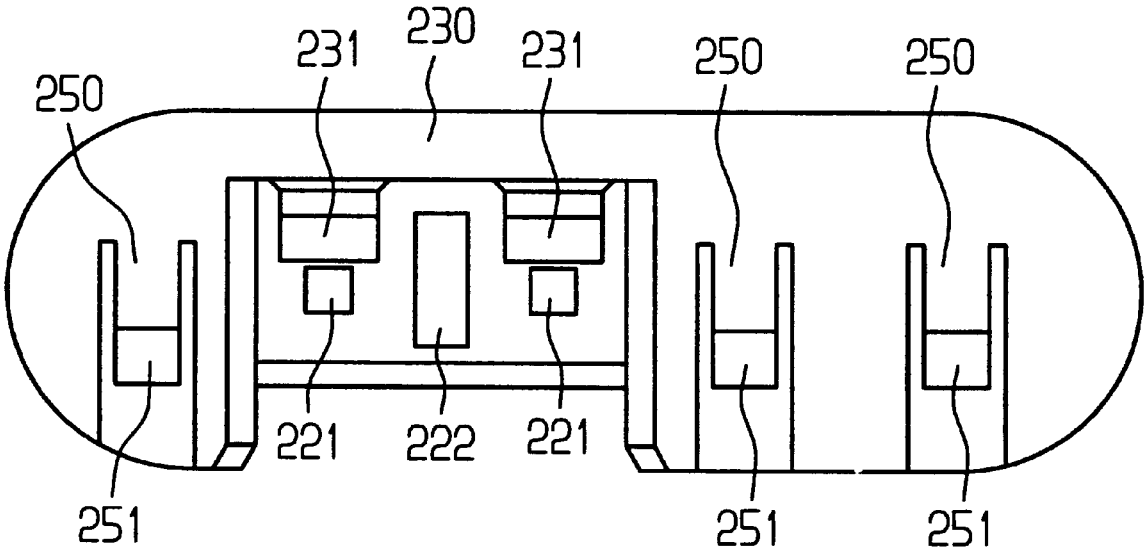
FIG. 7 is a right side view thereof.
Figure 8:
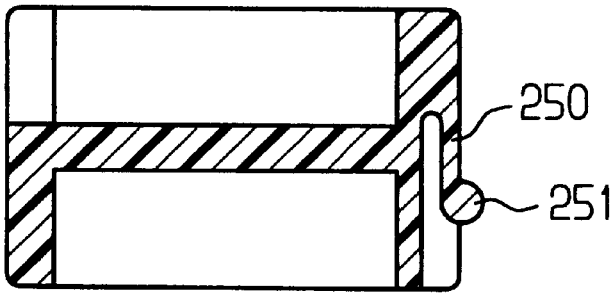
FIG. 8 is a lateral sectional view taken through latching noses of the contact-ensuring slide of FIG. 7.

The securing pins 231 are shown in FIGS. 7 and 9 in a lateral and frontal plan view, respectively, and in a further lateral (sectional) view in FIGS. 1 and 2.

The risk that the securing pins 231 do not project properly (canted, incompletely etc.) through the securing window 131, and the risk that the securing pin is removed inadvertently from its proper position are minimized by the construction of the electrical connector according to the invention as described above.

In order to enable monitoring the state of the primary safeguarding of the contact elements (position of the spring lugs 111) in the assembled state of the basic body 100 and contact-ensuring slide 200, the cover plate 230 of the contact-ensuring slide 200 has monitoring windows 232, which are shown in cross section in FIGS. 1 and 2 and in plan view in FIG. 9.

The security and reliability of the electrical connector may be further improved in that, in the state when connected to the electrical connector described, the mating component of the electrical connector accommodates the contact-ensuring slide 200, the contact-ensuring segment 102 of the basic body 100 and the radial seal 300, and thus on the one hand protects the contact-ensuring slide 200 against damage and undesired removal, and on the other hand keeps environmental influences such as dirt, dampness, etc. away from the interior of the electrical connector.

We claim:

1. An electrical connector, comprising:

a basic body;

at least one contact element insertable into said basic body and adapted to contact a corresponding mating component; and at least one securing pin insertable into said basic body preventing a removal of said at least one contact element from a defined position thereof in said basic body;

said at least one securing pin being part of a contact-ensuring slide slidable onto said basic body wherein said contact-ensuring slide is substantially U-shaped with limbs carrying guide elements; and an end plate is connected to said limbs.

2. An electrical connector, comprising:

a basic body defining a plug-in direction along which the electrical connector is plugged together with another electrical connector for electrical contact;

at least one contact element insertable into said basic body and adapted to contact a corresponding mating component;

a contact-ensuring slide to be brought into engagement with the basic body and said contact element for preventing removal of said contact element from a defined position thereof in said basic body, said contact-ensuring slide being slidable onto said basic body transversely to the plug-in direction;

said basic body and said contact-ensuring slide being formed with mutually complementary guide elements for guiding said basic body and said contact-ensuring slide upon being brought into mutual engagement, and with latching elements for latching said basic body and said contact-ensuring slide together;

said contact-ensuring slide including an end plate for covering a mating end face of said basic body when said contact-ensuring slide is disposed on said basic body; and said basic body formed with a base segment and a contiguous contact-ensuring segment, said contact-ensuring segment and said base segment each having an end face, and said latching elements of said basic body formed in said end face of said contact-ensuring segment and in said end face of said base segment.

3. An electrical connector, comprising:

a basic body defining a plug-in direction along which the electrical connector is plugged together with another electrical connector for electrical contact;

at least one contact element insertable into said basic body and adapted to contact a corresponding mating component;

a contact-ensuring slide to be brought into engagement with the basic body and said contact element for preventing removal of said contact element from a defined position thereof in said basic body, said contact-ensuring slide being slidable onto said basic body transversely to the plug-in direction;

said basic body and said contact-ensuring slide being formed with mutually complementary guide elements for guiding said basic body and said contact-ensuring slide upon being brought into mutual engagement, and with latching elements for latching said basic body and said contact-ensuring slide together;

said contact-ensuring slide including an end plate for covering a mating end face of said basic body when said contact-ensuring slide is disposed on said basic body; and said contact-ensuring slide having an end wall and a rear wall, and said latching elements of said contact-ensuring slide formed on said end wall and on said rear wall of said contact-ensuring slide.

4. An electrical connector, comprising:

a basic body defining a plug-in direction along which the electrical connector is plugged together with another electrical connector for electrical contact;

at least one contact element insertable into said basic body and adapted to contact a corresponding mating component;

a contact-ensuring slide to be brought into engagement with the basic body and said contact element for preventing removal of said contact element from a defined position thereof in said basic body, said contact-ensuring slide being slidable onto said basic body transversely to the plug-in direction;

said basic body and said contact-ensuring slide being formed with mutually complementary guide elements for guiding said basic body and said contact-ensuring slide upon being brought into mutual engagement, and with latching elements for latching said basic body and said contact-ensuring slide together;

said contact-ensuring slide including an end plate for covering a mating end face of said basic body when said contact-ensuring slide is disposed on said basic body; and said contact-ensuring slide being substantially U-shaped with limbs carrying said guide elements, and said end plate being connected to said limbs.

* * * * *